US008961262B2

(12) United States Patent
Hudimac, Jr.

(10) Patent No.: US 8,961,262 B2
(45) Date of Patent: Feb. 24, 2015

(54) MODEL MOTOR VEHICLE HIGHWAY SYSTEM

(71) Applicant: George S. Hudimac, Jr., Allentown, PA (US)

(72) Inventor: George S. Hudimac, Jr., Allentown, PA (US)

( * ) Notice: Subject to any disclaimer, the term of this patent is extended or adjusted under 35 U.S.C. 154(b) by 0 days.

(21) Appl. No.: 14/196,563

(22) Filed: Mar. 4, 2014

(65) Prior Publication Data

US 2014/0315471 A1 Oct. 23, 2014

Related U.S. Application Data

(63) Continuation-in-part of application No. 12/372,088, filed on Feb. 17, 2009, now Pat. No. 8,708,770.

(51) Int. Cl.
*A63H 18/00* (2006.01)
*A63H 17/00* (2006.01)

(52) U.S. Cl.
CPC ..... *A63H 17/008* (2013.01)
USPC ..... 446/446; 446/444; 446/457; 104/162

(58) Field of Classification Search
USPC ..... 104/305, 162, 167; 446/444–447, 457; D21/564–565
See application file for complete search history.

(56) References Cited

U.S. PATENT DOCUMENTS

| | | | | |
|---|---|---|---|---|
| 3,418,410 | A * | 12/1968 | Einfalt | 264/242 |
| 3,622,158 | A * | 11/1971 | Tepper et al. | 463/64 |
| 4,406,231 | A * | 9/1983 | Crimaldi | 104/172.2 |
| 4,568,300 | A * | 2/1986 | Rasmussen et al. | 446/129 |
| 8,708,770 | B2 * | 4/2014 | Hudimac, Jr. | 446/446 |
| 2004/0099175 | A1 * | 5/2004 | Perrot et al. | 104/138.1 |
| 2010/0210175 | A1 * | 8/2010 | Hudimac, Jr. | |

* cited by examiner

*Primary Examiner* — Gene Kim
*Assistant Examiner* — Matthew B Stanczak
(74) *Attorney, Agent, or Firm* — Design IP

(57) ABSTRACT

An elongated flexible open coil spring with spaced apart coils adapted to engage a guide pin on a slot car is placed in the slot of a model slot car track. Cars are positioned with their depending pins engaging the open coil spring to be carried around the track by a powered car held by and moving the open coil spring along the slot.

1 Claim, 2 Drawing Sheets

MODEL MOTOR VEHICLE HIGHWAY SYSTEM

BACKGROUND

The present invention relates to toy vehicle games and in particular, to the so-called slot car toy racing sets.

In the conventional slot car racing system, a pair of energized rails are placed in parallel relationship on either side of a slot in a track base. The rails contact electrically conductive shoes on a model car. The shoes electrically connect to a motor which drives the car. Depending from the bottom of the car is a pin that engages the walls of the slot to keep the car on the track when it is energized and to make sure the car follows the intended path defined by the various sections of the straight and curved track.

In conventional slot car systems, each car is powered and it is generally not possible to run more than one car on a given track at a time since if the motors are turning the wheels on different cars with different speeds, it is possible for one car to over take and crash into another car on the same track.

SUMMARY

According to the present invention, a system has been devised so that a string of cars can be made to move along a conventional slot car track with one of the cars being powered and the other cars moving by virtue of a flexible spring or rod placed in the bottom of the slot, the flexible spring having open coils which engage the pin on the slot car, or in the case of a flexible rod, the flexible rod having holes, detents, slots or other means to engage the pin of the slot car.

The flexible spring or rod is made so that it will follow along the track easily and to that extent has a tapered end section to facilitate moving in the slot and not being hung-up on slightly misaligned slot portions of successive track sections.

One powered car can be placed along the flexible spring or rod and other cars or other toy vehicles can be placed ahead of or behind the powered car so that when the powered car is energized, all of the cars move in what appears to be a moving line of traffic.

Such a system would be desirable in combination with a model railroad or as a stand alone automotive set.

Therefore, in one aspect, the present invention is a toy car system of the type having a track with a pair of energized rails to provide current to an electrically powered model car with a slot between the rails to engage a guide pin on the bottom of the car, the improvement comprising an elongated continuous length of a flexible sliding means disposed in the slot, the flexible sliding means containing means to engage a pin on a powered car and move along with the powered car, the sliding means adapted to extend beyond the powered car and position one or more additional cars one of behind, ahead, or behind and ahead of the powered car to create the appearance of the flow of traffic along the track.

In another aspect, the present invention is a method of operating a toy slot car system to move a non-powered car by a powered car comprising the steps of placing a continuous length of a flexible sliding means in the slot, the flexible sliding means adapted to engage a depending pin on the cars, positioning at least one powered car in the string of cars spaced randomly apart, and energizing the powered car to move the string of cars along the track associated with the slot.

BRIEF DESCRIPTION OF THE DRAWING(S)

DETAILED DESCRIPTION OF THE PREFERRED EMBODIMENT(S)

The present invention is drawn to an apparatus and method for creating a realistic-looking model highway with moving groups of traffic.

Figure 1:
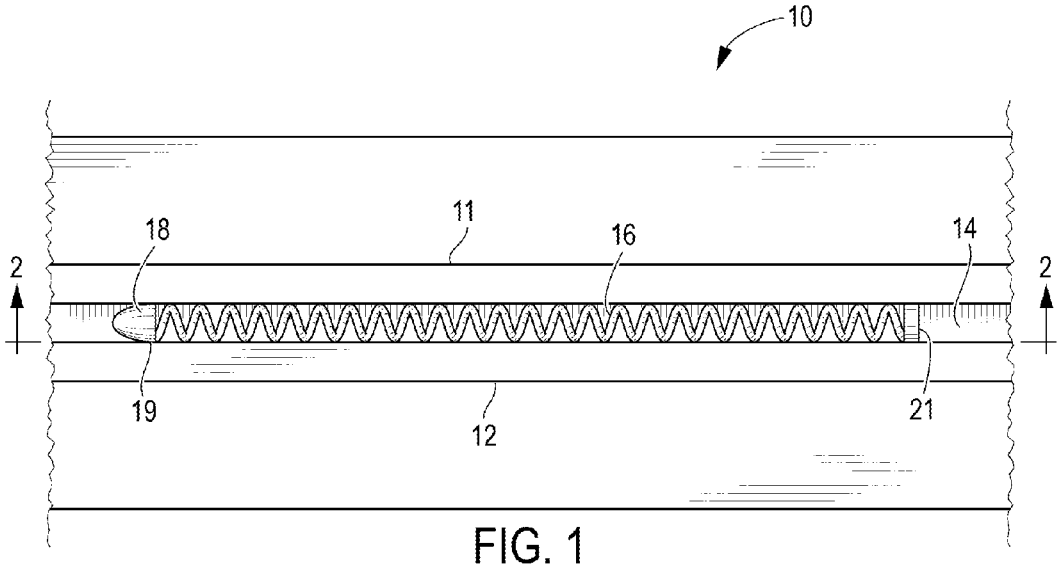
FIG. 1 is a top plan view of a section of track according to the invention.

Referring to FIG. 1, a track section 10 consists of powered rails 11, 12 with an intermediate slot 14 as is well known in the prior art.

Disposed within the slot 14 is a sliding flexible element 16, which in the case of FIG. 1 can be a coil spring, preferably, with the respective coils slightly open.

On one or the leading end 19 of the sliding flexible element 16 is a nose in the shape of a bullet 18 which facilitates movement of the spring in the slot and avoids hang-ups as the spring moves along the slot in successive sections of track where there maybe a slight misalignment between the sections of track. The other or trailing end of the sliding flexible element 16 is generally square to the longitudinal axis of the spring or is fitted with a generally flat plug 21.

Figure 2:
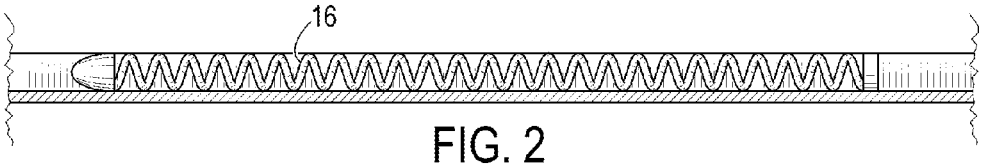
FIG. 2 is a view taken along lines 2-2 of FIG. 1.

FIG. 2 shows the sliding flexible element 16 in more detail, again a spring with a flexible, slightly open coil configuration to readily receive a guide pin on a vehicle disposed on the track.

Figure 3:
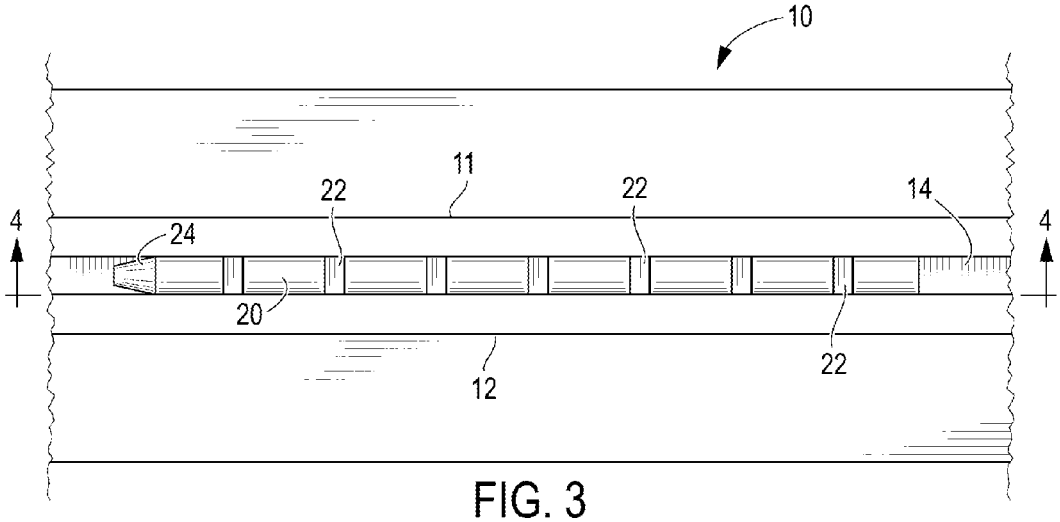
FIG. 3 is a top plan view of an alternate embodiment of a track according to the present invention.
Figure 4:
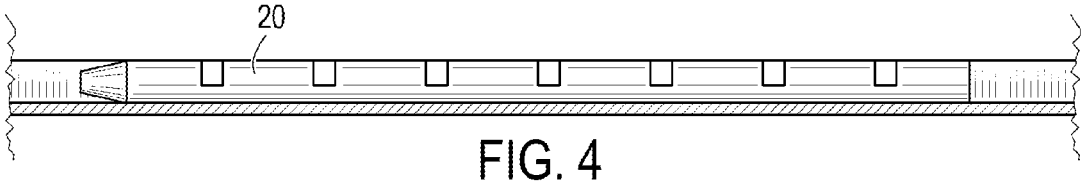
FIG. 4 is a view taken along lines 4-4 of FIG. 3.

Referring to FIG. 3, the track 10 with the powered rails 11, 12 and slot 14 contains a sliding flexible member 20 in the form of a flexible rod which contains along its length a plurality of slots, detents, holes or the like 22. The sliding flexible member 20 can have a tapered front end 24 to once again facilitate movement of the rod in the slot.

In either case, for the devices of FIGS. 1 and 2 and 3 and 4, the sliding flexible element 16 or 20 can have a tapered or bullet shaped end to facilitate forward movement of the sliding flexible element in the slot 14.

The sliding flexible element 16 or 20 is sized so that it moves freely in the slot without popping out of the slot as it is gliding along.

Figure 5:
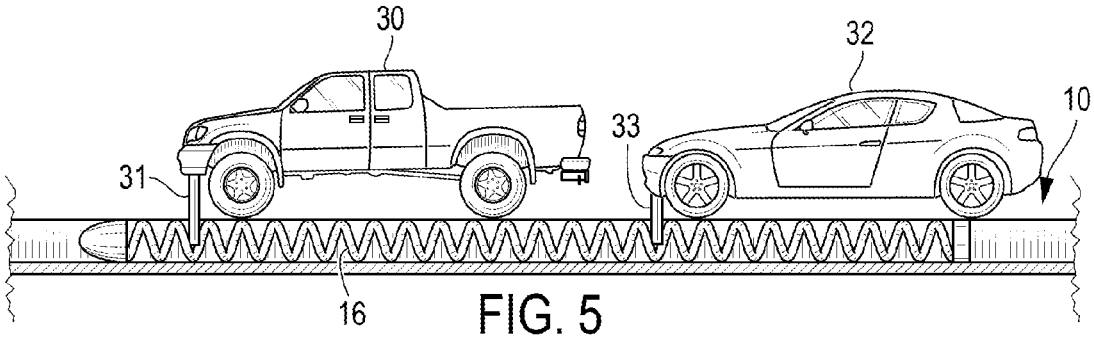
FIG. 5 is a side elevational view according to FIG. 2 with vehicles placed on the track.

Referring to FIG. 5, cars 30 and 32, which may be in the form of a model pick-up truck or sedan or station wagon, each containing a respective guide pin 31, 33 can be placed on the track 10 with the pin engaging an open portion of the sliding flexible element 16. In this embodiment, either of the cars 30, 32 can be powered which will move the sliding flexible element 16 along the slot and carry the non-powered member along with it. Depending upon the length of the sliding flexible element 16, several vehicles can be carried along in this manner.

Figure 6:
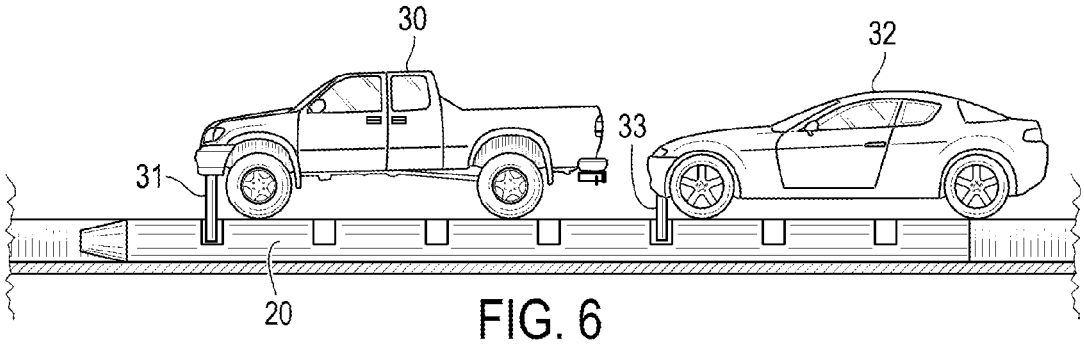
FIG. 6 is a view similar to FIG. 4 with vehicles placed on the track.

Referring to FIG. 6, vehicles 30, 32 containing pins 31, 33, are disposed along the sliding flexible member 20 in a similar manner. In the case of the device of FIG. 6, the pins are fitted into a slot or a hole in the sliding flexible member 20.

Depending upon the length of the sliding flexible element 16, 20 several vehicles can be added to the group. In either case, one or more of the vehicles may be powered, and powered and non-powered vehicles can be mixed within a given group. In any event, depending upon the number of cars to be disposed in a moving group the number of powered cars will be selected accordingly.

It can be seen from the foregoing that a conventional slot car set can be configured for use by itself or in conjunction with a model railroad to create moving traffic in a highway system to compliment the car set itself or the model railroad.

Having thus described my invention what is desired to be secured by Letters Patent of the United States is set forth in the appended Claims.

What is claimed is:

1. A method of operating a toy slot car system to move a non-powered car by a powered car comprising the steps of:

selecting a length of an open coil spring adapted to slide freely in said slot of said slot toy slot car system and to engage a depending pin of said powered and non-powered cars;

placing a generally bullet shaped tapering plug in one end of said length of open coil spring;

placing said length of open coil spring in said slot with said tapering plug facing the direction of travel of said cars;

positioning at least one powered car in a string of non-powered cars spaced randomly apart along said open coil spring; and energizing said powered car to move open coil spring and said string of non-powered cars along track associated with said slot.

* * * * *